US011230810B2

(12) United States Patent
Machida et al.

(10) Patent No.: US 11,230,810 B2
(45) Date of Patent: Jan. 25, 2022

(54) POLYIMIDE FIBER SHEET

(71) Applicants: DU PONT-TORAY CO., LTD., Tokyo (JP); TOYOTA TSUSHO MATEX CORPORATION, Osaka (JP); HIROSE PAPER MFG CO., LTD., Tosa (JP)

(72) Inventors: Hideaki Machida, Tokyo (JP); Shotaro Hidaka, Tokyo (JP); Takaharu Kuno, Tokai (JP); Naruaki Takahashi, Tokyo (JP); Gen Ueta, Tosa (JP)

(73) Assignees: DU PONT-TORAY CO., LTD.; TOYOTA TSUSHO MATEX CORPORATION; HIROSE PAPER MFG CO., LTD.

( * ) Notice: Subject to any disclaimer, the term of this patent is extended or adjusted under 35 U.S.C. 154(b) by 94 days.

(21) Appl. No.: 16/626,271

(22) PCT Filed: Aug. 7, 2018

(86) PCT No.: PCT/JP2018/029616

§ 371 (c)(1),
(2) Date: Dec. 23, 2019

(87) PCT Pub. No.: WO2019/031506

PCT Pub. Date: Feb. 14, 2019

(65) Prior Publication Data

US 2020/0115852 A1 Apr. 16, 2020

(30) Foreign Application Priority Data

Aug. 10, 2017 (JP) ..... JP2017-155353

(51) Int. Cl.

| | |
|---|---|
| ***D21H 13/26*** | (2006.01) |
| ***D21H 17/56*** | (2006.01) |
| ***D21H 23/24*** | (2006.01) |

(52) U.S. Cl.
CPC ..... *D21H 13/26* (2013.01); *D21H 17/56* (2013.01); *D21H 23/24* (2013.01)

(58) Field of Classification Search
USPC ..... 162/157.2
See application file for complete search history.

(56) References Cited

U.S. PATENT DOCUMENTS

2007/0084575 A1* 4/2007 Furukawa ..... H05K 1/0366 162/157.1

FOREIGN PATENT DOCUMENTS

| | | | |
|---|---|---|---|
| CN | 102747634 | A | 10/2012 |
| CN | 106436441 | A | 2/2017 |
| CN | 106638114 | A | 5/2017 |
| JP | H10-100347 | A | 4/1998 |
| JP | H11-200210 | A | 7/1999 |
| JP | 2000-154491 | A | 6/2000 |
| JP | 2001-192955 | A | 7/2001 |
| JP | 2003-096698 | A | 4/2003 |
| JP | 2006-176906 | A | 7/2006 |
| JP | 2006-176907 | A | 7/2006 |
| JP | 2009-097117 | A | 5/2009 |
| JP | 2009-113582 | A | 5/2009 |

* cited by examiner

*Primary Examiner* — Mark Halpern
(74) *Attorney, Agent, or Firm* — Harness, Dickey & Pierce, P.L.C.

(57) ABSTRACT

A polyimide fiber paper-manufacturing method is provided that includes a short fiber-preparing step in which shaved short fibers of a non-thermoplastic polyimide are prepared, and a provisionally-bonded paper-forming step in which the short fibers are mixed with water-soluble polymers which are a material having a decomposition temperature lower than a glass transition point of polyimide, and subjected to wet-papermaking to form provisionally-bonded paper.

15 Claims, 18 Drawing Sheets

POLYIMIDE FIBER SHEET

CROSS REFERENCE TO RELATED APPLICATIONS

This application is a National Stage Application of PCT/JP2018/029616 filed on Aug. 7, 2018 and published in Japanese as WO2019/031506 on Feb. 14, 2019, which claims priority to Japanese Patent Application No. JP-2017-155353 filed on Aug. 10, 2017. All of the above applications are hereby expressly incorporated by reference herein in their entireties.

BACKGROUND

Technical Field

The present invention relates to paper composed of polyimide fibers.

Related Art

Polyimide films are materials excellent in electric insulation, heat resistance, cold resistance, heating retardancy, chemical resistance, and mechanical characteristics, and have been increasingly demanded in a wide range of fields from aerospace applications to automotive and communication equipment applications. However, for the polyimide films, heat insulation, gas and liquid permeability, and permeability are limited due to characteristics of films. A flexible sheet product in which these characteristics are improved while exploiting a high functionality of polyimide has been expected to be developed. In general, increase in a thickness of a polyimide film leads to a high cost and a high weight. Thus, there has been a demand for development of a thick and lightweight polyimide sheet product with a low cost.

A method of producing a polyimide nonwoven fabric material using polyimide fibers is exemplified by techniques described in Japanese Patent Application Laid-Open No. 2003-96698 and Japanese Patent Application Laid-Open No. 2003-96698.

However, a polyimide material described in the prior Japanese Patent Application Laid-Open No. 2003-96698 has a problem that heat resistance is low because a thermoplastic polyimide is used for polyimide fibers.

In addition, a polyimide material described in the prior Japanese Patent Application Laid-Open No. 2009-97117 is made only of a non-thermoplastic polyimide with a high heat resistance, but has problems that a special manufacturing apparatus is required and that it is difficult and expensive to achieve a uniform thickness, particularly to obtain a wide sheet product, because of a step that a polyimide precursor solution is spun, drawn with a high-speed airflow, captured on a base material, and then imidized.

SUMMARY

In order to solve the above problems, the present invention provides following polyimide fiber paper and the like. The present invention provides a polyimide fiber paper-manufacturing method, including a short fiber-preparing step in which shaved short fibers of a non-thermoplastic polyimide are prepared, and a provisionally-bonded paper-forming step in which the short fibers are mixed with water-soluble polymers which are a material having a decomposition temperature lower than a glass transition point of polyimide, and subjected to wet-papermaking to form provisionally-bonded paper to which the shaved short fibers are provisionally bonded.

Next, the present invention provides the polyimide fiber paper-manufacturing method, further including a polyimide precursor-dispersing step in which a polyimide precursor is dispersed in the provisionally-bonded paper after the provisionally-bonded paper-forming step.

Next, the present invention provides the polyimide fiber paper-manufacturing method, further including a polyimide solution-dispersing step in which a polyimide solution is dispersed in the provisionally-bonded paper after the provisionally-bonded paper-forming step.

Next, the present invention provides the polyimide fiber paper-manufacturing method, further including a water-soluble-polymer-completely-removing step in which the water-soluble polymers are completely removed by hear-treating after the provisionally-bonded paper-forming step.

Next, the present invention provides the polyimide fiber paper-manufacturing method, further including a water-soluble-polymer-partially-removing step in which water-soluble polymers are partially removed by hear-treating after the provisionally-bonded paper-forming step.

Next, the present invention provides the polyimide fiber paper-manufacturing method, further including the polyimide precursor-dispersing step in which the polyimide precursor is dispersed in the provisionally-bonded paper after the water-soluble-polymer-completely-removing step.

Next, the present invention provides the polyimide fiber paper-manufacturing method, further including the polyimide precursor-dispersing step in which the polyimide precursor is dispersed in the provisionally-bonded paper after the water-soluble-polymer-partially-removing step.

Next, the present invention provides the polyimide fiber paper-manufacturing method, further including the polyimide solution-dispersing step in which the polyimide solution is dispersed in the provisionally-bonded paper after the water-soluble-polymer-completely-removing step.

Next, the present invention provides the polyimide fiber paper-manufacturing method, further including the polyimide solution-dispersing step in which the polyimide solution is dispersed in the provisionally-bonded paper after the water-soluble-polymer-partially-removing step.

Next, the present invention provides the polyimide fiber paper-manufacturing method, further including an imidization step in which the polyimide precursor is imidized by heating after the polyimide precursor-dispersing step.

Next, the present invention provides the polyimide fiber paper-manufacturing method, further including an imidization step in which the precursor contained in the polyamide is imidized by heating after the polyimide solution-dispersing step.

Next, the present invention provides a polyimide fiber paper intermediate structure A in which water-soluble polymers having a decomposition temperature lower than a glass transition point of polyimide are dispersed in nonwoven fabric of shaved non-thermoplastic polyimide short fibers.

Next, the present invention provides a polyimide fiber paper intermediate structure B in which heat-denatured products of water-soluble polymers having a decomposition temperature lower than a glass transition point of polyimide are dispersed in nonwoven fabric of shaved non-thermoplastic polyimide short fibers.

Next, the present invention provides a polyimide fiber paper intermediate structure C in which heat-denatured products of water-soluble polymers having a decomposition temperature lower than a glass transition point of polyimide are dispersed in nonwoven fabric of shaved non-thermoplastic polyimide short fibers, and which is impregnated with a polyimide precursor or a polyimide solution.

Next, the present invention provides the polyimide fiber paper-manufacturing method, in which a content of the water-soluble polymers is greater than or equal to 1 wt % and less than or equal to 50 wt % with respect to polyimide.

Next, the present invention provides the polyimide fiber paper-manufacturing method, in which the water-soluble polymer is any one or more of starch, alginic acid, carboxymethylcellulose, casein, vinylon, polyvinyl alcohol, vinyl acetate, polyvinyl acetate, and/or derivatives of these polymers.

Next, the present invention provides the polyimide fiber paper-manufacturing method, in which a length of the polyimide short fiber is greater than or equal to 1.0 mm and less than or equal to 10.0 mm.

Next, the present invention provides the polyimide fiber paper-manufacturing method, in which a length of the polyimide short fiber is greater than or equal to 2.0 mm and less than or equal to 6.0 mm.

Next, the present invention provides the polyimide fiber paper-manufacturing method, in which a width of the polyimide short fiber is greater than or equal to 1 μm and less than or equal to 50 μm.

Next, the present invention provides the polyimide fiber paper-manufacturing method, in which a width of the polyimide short fiber is greater than or equal to 3 μm and less than or equal to 25 μm.

Effects of the Invention

The present invention makes it possible to manufacture polyimide fiber paper in which a content of the thermoplastic polyimide component in a constituent material is approximately 100%. The present invention can provide a method for manufacturing a material which can sufficiently exhibit characteristics inherent to the non-thermoplastic polyimide, and is excellent in heat resistance, flame retardancy, electric insulation, heat insulation, and lightness.

Also, the polyimide fiber paper or an intermediate structure thereof according to the present invention can be laminated together with another material by using adhesiveness of the intermediate structure, so that a composite material for enhancing or adding characteristics can be provided.

DETAILED DESCRIPTION

Hereinafter, the embodiments of the present invention will be explained by using appended drawings. In the following description, Embodiments 1, 2, 3, 4, 5, 6, 7, 8, 9, 10, 11, 12, 13, 14, 15, 16, 17, 18, 19 and 20 correspond to Inventions 1, 2, 3, 4, 5, 6, 7, 8, 9, 10, 11, 12, 13, 14, 15, 16, 18, 19, 20 and 21, respectively. It should be noted that the present invention should not be limited to these embodiments in any way and may be performed in various modes without departing from the gist thereof.

Embodiment 1

Embodiment 1. Summary

In a polyimide fiber paper-manufacturing method according to the present embodiment, polyimide fiber paper can be manufactured without a special apparatus, by using a method in which polyimide fibers obtained by shaving a cylindrically rolled polyimide film are subjected to wet-papermaking like manufacturing Japanese paper, and a plurality of heating/pressurizing steps.

Embodiment 1. Configuration

Figure 1:
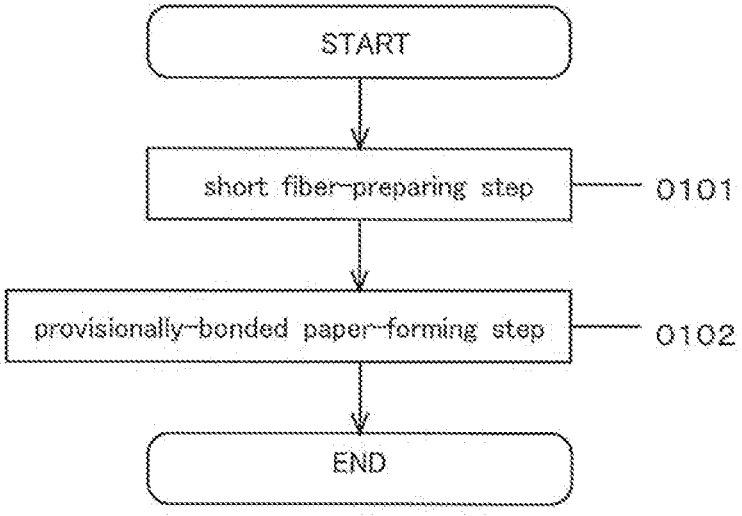
FIG. 1 is a flow chart illustrating an example of a polyimide fiber paper-manufacturing method in Embodiment 1.

FIG. 1 is a flow chart illustrating an example of a polyimide fiber paper-manufacturing method of the present embodiment. As illustrated, the polyimide fiber paper-manufacturing method includes a short fiber-preparing step (0101), and a provisionally-bonded paper-forming step (0102).

Embodiment 1. Explanation of Configuration

Embodiment 1. Short Fiber-Preparing Step

In the "short fiber-preparing step", the shaved short fibers of the non-thermoplastic polyimide are prepared. The shaving of polyimide refers to a method in which a polyimide film roll obtained by rolling a belt-shaped polyimide film into a cylindrical shape is rotated, and a blade is applied to a side face of the rotating polyimide film roll to shave polyimide fibers. The blade is applied to the polyimide film roll while rotating the roll, so that a bundle of very fine polyimide fibers corresponding to thicknesses of the film and the blade can be made. This bundle of the polyimide fibers is cut to prepare polyimide short fibers.

Since the polyimide fibers are obtained by the shaving, widths of the fibers are uniform, and therefore processing in the subsequent process is facilitated. Furthermore, a thickness of the polyimide film constituting the polyimide film roll and a sharpness of a tip of the blade for the shaving are adjusted, so that the widths of the polyimide fibers to be shaved can be easily changed, and fibers having widths smaller than those of fibers made by a spinning method can be easily made. Also, lengths of the fibers can be freely adjusted by cutting the bundle of the shaved fibers.

Since the widths and lengths of the fibers can be freely combined, polyimide fiber papers having various strengths and durabilities can be made by changing the widths and lengths of the fibers according to the application of the polyimide fiber paper.

Embodiment 1. Provisionally-Bonded Paper-Forming Step

In the "provisionally-bonded paper-forming step", water-soluble polymers having a decomposition temperature lower than a glass transition point of polyimide are mixed with the shaved polyimide short fibers, which is subjected to wet-papermaking to form a provisionally-bonded paper. The provisionally-bonded paper-forming step includes a composite slurry-forming process, a sheeting process, and a fusion process. The wet-papermaking refers to a step of mixing the polyimide short fibers and the water-soluble polymers, and screening the composite slurry dispersed in water, to sheet the slurry. The provisional bond facilitates the subsequent handling.

It is preferable to use water-soluble polymers that does not dissolve in water at normal temperature, and in this case, the water-soluble polymers in the composite slurry are in a form of fiber and/or powder.

In the composite slurry-forming process, the polyimide short fibers and the water-soluble polymers having the decomposition temperature lower than the glass transition point of polyimide are mixed to form a composite slurry. For example, a dispersant (e.g. water-soluble polyurethane resin, TEXANOL PE-10F manufactured by Yoshimura Oil Chemical Co., Ltd.), a defoamer (e.g. FOAMLESS P NEW, manufactured by Meisei Chemical Works, Ltd.), a thickener (e.g. polyacrylamide-based thickener, MEIPAM manufactured by Meisei Chemical Works, Ltd.) and the like, that are usually used as additives for papermaking, may be added as required, but the present invention is not particularly limited thereto. The dispersant and the thickener improve dispersibility of the polyimide short fibers and the water-soluble polymers, and the defoamer suppresses generation of bubbles causing pinholes. Since these additives hardly remain as solid components in the provisionally-bonded paper, it is not necessary to remove them.

Since the polyimide short fibers are fibers, they can tangle in an aqueous solution, but do not include binder fibers acting as a binder for firmly fusing tangled short fibers due to high heat resistance inherent to polyimide. Consequently, the tangled fibers in a wet state are difficult to unwind due to weight of water, but when the fibers are dried, the tangled fibers are easily unwound and the paper state cannot be maintained. Thus, a dispersion slurry mixed with the water-soluble polymers is screened, so that the polyimide short fibers that are tangled like Japanese paper fibers when screening the short fibers can be maintained in the tangled state even when dried. The water-soluble polymers dissolve when heated at a dissolution temperature. At this time, the water-soluble polymers are heat-fused while sandwiching the polyimide short fibers, so that the polyimide short fibers are fixedly tangled. Alternatively, the water-soluble polymers bind to the polyimide short fibers, so that the polyimide short fibers are fixedly tangled. The water-soluble polymers are dispersed for the purpose of causing heat fusion. The water-soluble polymers to be dispersed needs to have a heat fusion temperature lower than the glass transition point of polyimide. When the decomposition temperature causing heat fusion of the water-soluble polymers is higher than the glass transition point of polyimide, deterioration of polyimide may proceed depending on a relationship between a temperature and a time of fusion.

In the sheeting process, a known wire or the like that is usually used in papermaking is used to form a sheet. A sheet formed by filtering a composite slurry with a wire or the like (filtering is referred to as "screening" in the manufacturing step in the present invention) is referred to as a wet paper.

In the fusing process, the wet paper sheeted by screening using the wire or the like is heated, and the water-soluble polymers are heat-fused through dissolution.

Figure 2:
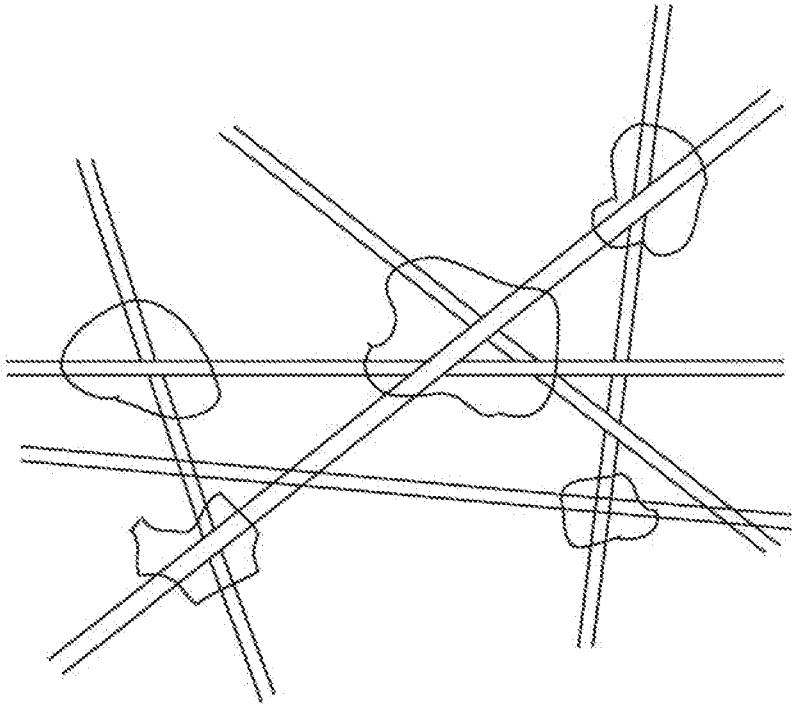
FIG. 2 is an enlarged conceptual diagram of provisionally-bonded paper in the present invention.

The water-soluble polymers dissolve when heated at a decomposition temperature. Once the water-soluble polymers dissolve, the water-soluble polymers are heat-fused, and the polyimide short fibers are fixedly tangled so as to be sandwiched between the heat-fused water-soluble polymers, as shown in FIG. 2. Alternatively, the polyimide short fibers adhere to the heat-fused water-soluble polymers, so that the polyimide short fibers are fixedly tangled. However, the polyimide short fibers theirselves are not heat-fused, and furthermore the fixation caused by the heat fusion of the water-soluble polymers is in a weak fixation state in which fibers are provisionally bonded with a low fixation strength, few fixation points, and a low durability.

Embodiment 1. Effect

The polyimide fiber paper-manufacturing method of the present embodiment makes it possible to manufacture polyimide fiber paper having a uniform thickness, and wide sheet-like polyimide fiber paper having a uniform thickness without using a special apparatus.

Embodiment 2

Embodiment 2. Summary

The present embodiment is a polyimide fiber paper-manufacturing method in which a step of dispersing the polyimide precursor in the provisionally-bonded paper is added after the polyimide fiber paper-manufacturing method of Embodiment 1.

Embodiment 2. Configuration

Figure 3:
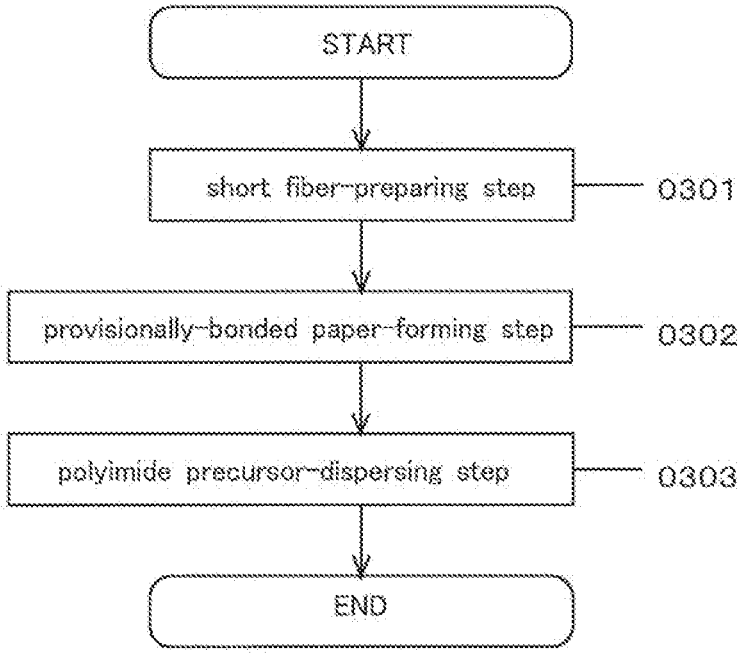
FIG. 3 is a flow chart illustrating an example of a polyimide fiber paper-manufacturing method in Embodiment 2.

FIG. 3 is a flow chart illustrating an example of a polyimide fiber paper-manufacturing method of the present embodiment. As illustrated, the polyimide fiber paper-manufacturing method of the present embodiment includes a short fiber-preparing step (0301), a provisionally-bonded paper-forming step (0302), and a polyimide precursor-dispersing step (0303). In the following, explanation of the common configuration with Embodiment 1 will be omitted, and the configuration characteristic of the present embodiment will be explained.

Embodiment 2. Explanation of Configuration

Embodiment 2. Polyimide Precursor-Dispersing Step

Figure 4:
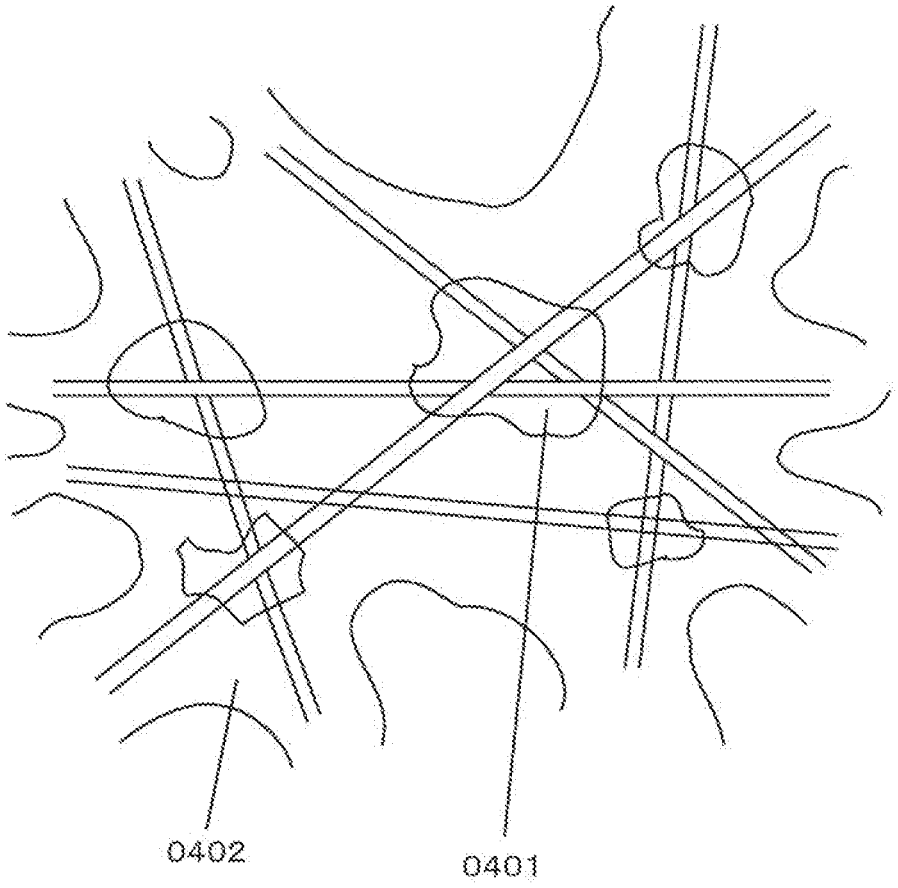
FIG. 4 is an enlarged conceptual diagram of a state that a polyimide precursor solution or a polyimide solution is dispersed in the provisionally-bonded paper in the present invention.

In the "polyimide precursor-dispersing step", the polyimide precursor is dispersed in the provisionally-bonded paper after the provisionally-bonded paper-forming step. The polyimide precursor is a polyamic acid that is supposed to become a non-thermoplastic polyimide by an imidization reaction, and is supposed to be dispersed as a polyimide precursor solution in the dispersion step. Once the polyimide precursor solution is dispersed, a film of the polyimide precursor solution (0402) is formed so as to cover the whole polyimide short fibers while including the water-soluble polymers (0401) that provisionally fix the polyimide short fibers in the provisionally-bonded paper, as illustrated in FIG. 4.

Specific examples of the method for dispersing the polyimide precursor may include a method in which the provisionally-bonded paper is impregnated with the polyimide precursor, an excess solvent in the polyimide precursor solution used for the impregnation is removed, and the provisionally-bonded paper impregnated with the polyimide precursor is dried, so that only the polyimide precursor from which the excess solvent is removed, and the water-soluble polymers fixing the polyimide short fibers are left and added in the provisionally-bonded paper. As described in the above process, the polyimide precursor-dispersing step refers to the step in which the polyimide precursor as a component for definitively bonding the provisionally-bonded paper is added to the provisionally-bonded paper.

In the process of drying the polyimide precursor solution used for the impregnation, the imidization reaction involving the polyimide precursor does not occur.

Embodiment 2. Effect of Invention

The polyimide fiber paper-manufacturing method of the present embodiment makes it possible to manufacture polyimide fiber paper having a uniform thickness, and wide sheet-like polyimide fiber paper having a uniform thickness without using a special apparatus.

Embodiment 3

Embodiment 3. Summary

The present embodiment is a polyimide fiber paper-manufacturing method in which a step of dispersing the polyimide solution is added after the provisionally-bonded paper-forming step of the polyimide fiber paper-manufacturing method described in Embodiment 1 or 2.

Embodiment 3. Configuration

Figure 5:
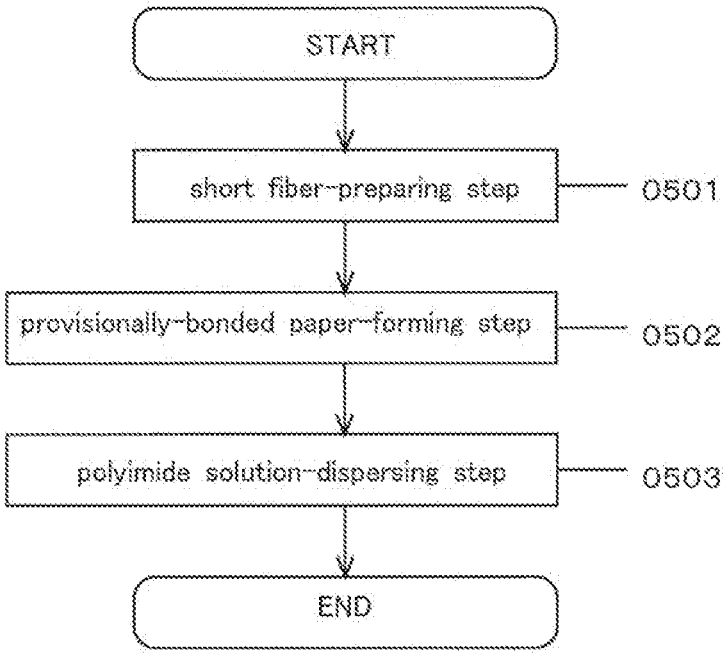
FIG. 5 is a flow chart illustrating an example of a polyimide fiber paper-manufacturing method in Embodiment 3.

FIG. 5 is a flow chart illustrating an example of the most basic polyimide fiber paper-manufacturing method of the present embodiment. As illustrated, the polyimide fiber paper-manufacturing method of the present embodiment includes a short fiber-preparing step (0501), a provisionally-bonded paper-forming step (0502), and a polyimide solution dispersing step (0503). In the following, explanation of the common configuration with Embodiment 1 or 2 will be omitted, and the configuration characteristic of the present embodiment will be explained.

Embodiment 3. Explanation of Configuration

Embodiment 3. Polyimide-Solution Dispersing Step

In the "polyimide-solution dispersing step", the polyimide solution is dispersed in the provisionally-bonded paper after the provisionally-bonded paper-forming step. As in the case shown in FIG. 4 where the polyimide precursor solution is dispersed, once the polyimide precursor solution is dispersed, a film of the polyimide solution is formed so as to include the water soluble polymers fixing the polyimide short fibers and cover the polyimide short fibers.

Specific examples of the method for dispersing the polyimide may include a method in which the provisionally-bonded paper is impregnated with the polyimide solution and added in the provisionally-bonded paper. The polyimide-dispersing step refers to the step in which the polyimide as a component for definitively bonding the provisionally-bonded paper is added to the provisionally-bonded paper.

Embodiment 3. Effect

The polyimide fiber paper-manufacturing method of the present embodiment makes it possible to manufacture polyimide fiber paper having a uniform thickness, and wide sheet-like polyimide fiber paper having a uniform thickness without using a special apparatus.

Embodiment 4

Embodiment 4. Summary

The present embodiment is a polyimide fiber paper-manufacturing method in which a step of completely removing the water-soluble polymers is added after the provisionally-bonded paper-forming step of the polyimide fiber paper-manufacturing method of any one of Embodiments 1 to 3.

Embodiment 4. Configuration

Figure 6:
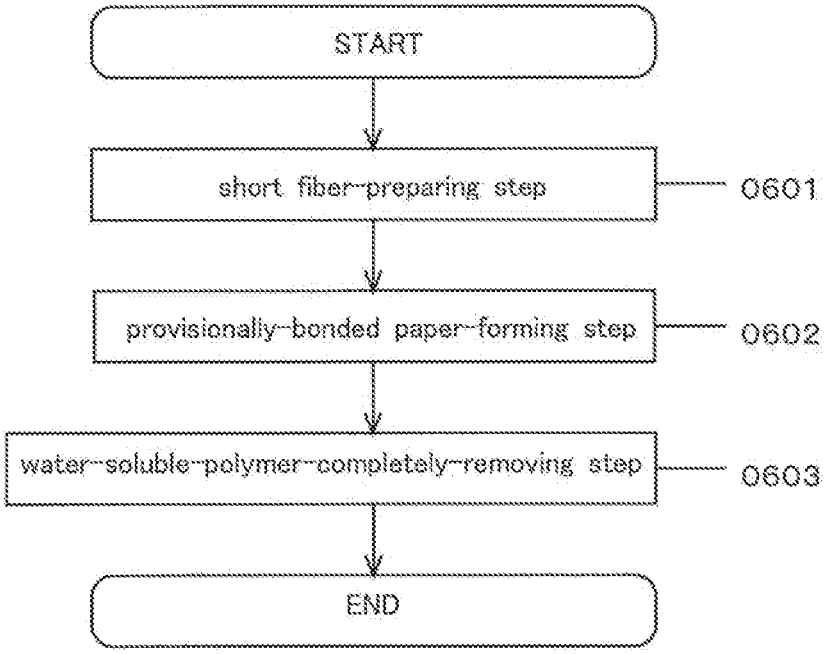
FIG. 6 is a flow chart illustrating an example of a polyimide fiber paper-manufacturing method in Embodiment 4.

FIG. 6 is a flow chart illustrating an example of a polyimide fiber paper-manufacturing method of the present embodiment. As illustrated, the polyimide fiber paper-manufacturing method of the present embodiment includes a short fiber-preparing step (0601), a provisionally-bonded paper-forming step (0602), and a water-soluble-polymer-completely-removing step (0603). In the following, explanation of the common configuration with any one of Embodiments 1 to 3 will be omitted, and the configuration characteristic of the present embodiment will be explained.

Embodiment 4. Explanation of Configuration

Embodiment 4. Water-Soluble-Polymer-Completely-Removing Step

In the "water-soluble-polymer-completely-removing step", the water-soluble polymers are completely removed by heating treatment after the provisionally-bonded paper-forming step. For example, the provisionally-bonded paper is sandwiched between two heat rolls, and heated to decompose the water-soluble polymers. This step is a processing method which is referred to as so-called calendering.

A temperature of the heat rolls for the water-soluble-polymer-completely-removing step is 190 to 250° C. The temperature needs to be a temperature at which the water-soluble polymers are reliably decomposed, and a temperature at which the polyimide precursor used for the impregnation is not imidized in the case according to Embodiment 2, or a temperature at which the polyimide precursor in the polyimide solution used for the impregnation is not imidized in the case according to Embodiment 3.

Figure 7:
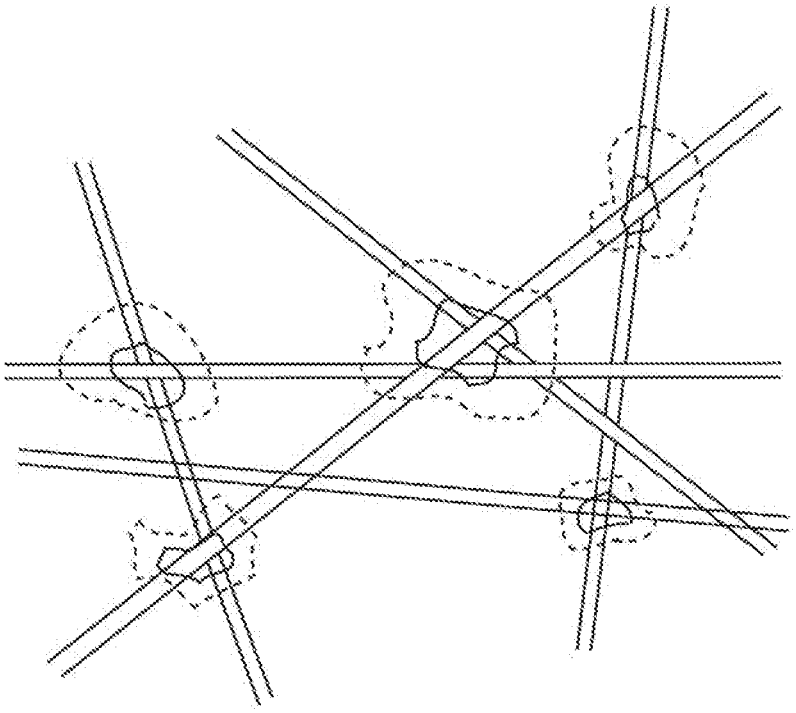
FIG. 7 is an enlarged conceptual diagram of a state after a water-soluble-polymer-completely-removing step in the present invention.

In the process of removing the water-soluble polymers by heating treatment, most of the water-soluble polymers are removed, and a part of the water-soluble polymers is heat-denatured and left in the provisionally-bonded paper. The remaining heat-denatured products of the water-soluble polymers act to prevent dispersion of the provisionally-bonded paper from which the water-soluble polymers are removed, and to maintain the state in which the polyimide fibers in the provisionally-bonded paper are tangled. FIG. 7 is a diagram illustrating a state of the polyimide fiber paper after the water-soluble-polymer-completely-removing step. A portion surrounded by a dotted line in the figure is a portion for step of the polyimide short fibers with the water-soluble polymers in the provisionally-bonded paper. Inside the portion surrounded by the dotted line, the portion indicated by the solid line refers to the heat-denatured products of the water-soluble polymers remaining in the polyimide fiber paper after completely removing the water-soluble polymers. As illustrated in the figure, even if the water-soluble polymers are completely removed without imidization, the heat-denatured products of the water-soluble polymers fix the polyimide short fibers, and therefore the provisionally-bonded paper is not dispersed. Furthermore, the provisionally-bonded paper after the water-soluble-polymer-completely-removing step causes viscosity of the heat-denatured products of the water-soluble polymers, and therefore can be heat-fused with other heat-fusible materials.

Embodiment 4. Effect

The polyimide fiber paper-manufacturing method of the present embodiment makes it possible to manufacture polyimide fiber paper having a uniform thickness, and wide sheet-like polyimide fiber paper having a uniform thickness without using a special apparatus.

Embodiment 5

Embodiment 5. Summary

The invention in the present embodiment relates to a polyimide fiber paper-manufacturing method in which only a part of the water-soluble polymers is removed so as to leave a part of the water-soluble polymers in the provisionally-bonded paper after the provisionally-bonded paper-forming step of the polyimide fiber paper-manufacturing method according to any one of Embodiments 1 to 3.

Embodiment 5. Configuration

Figure 8:
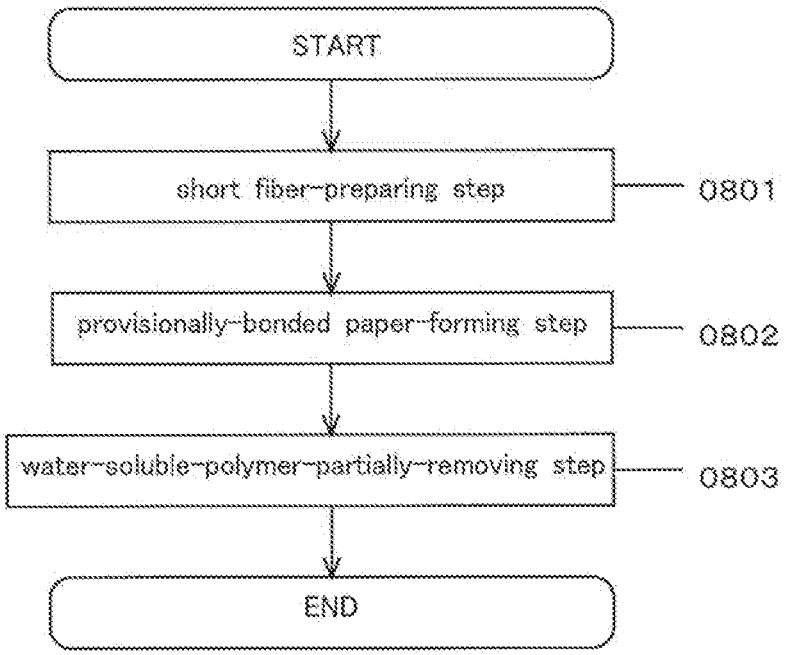
FIG. 8 is a flow chart illustrating an example of a polyimide fiber paper-manufacturing method in Embodiment 5.

FIG. 8 is a flow chart illustrating an example of the most basic polyimide fiber paper-manufacturing method of the present embodiment. As illustrated, the polyimide fiber paper-manufacturing method of the present embodiment includes a short fiber-preparing step (0801), a provisionally-bonded paper-forming step (0802), and a water-soluble-polymer-partially-removing step (0803). In the following, explanation about the common configuration with any one of Embodiments 1 to 4 will be omitted, and the points characteristic of the present embodiment will be explained.

Embodiment 5. Explanation of Configuration

Embodiment 5. Water-Soluble-Polymer-Partially-Removing Step

In the "water-soluble-polymer-partially-removing step", a part of water-soluble polymers are removed by heating treatment after the provisionally-bonded paper-forming step. In the water-soluble-polymer-partially-removing step, for example, a so-called calendaring method can be contemplated in which the provisionally-bonded paper is sandwiched between two heat rolls, and heated to decompose the water-soluble polymers is contemplated as in the case of the water-soluble-polymer-completely-removing step.

A temperature of the heat rolls for the water-soluble-polymer-completely-removing step is 190 to 250° C. as in the case of the water-soluble-polymer-completely-removing step. The temperature needs to be a temperature at which the water-soluble polymers are reliably decomposed, and a temperature at which the polyimide precursor used for the impregnation is not imidized in the case according to Embodiment 2, or a temperature at which the polyimide precursor in the polyimide solution used for the impregnation is not imidized in the case according to Embodiment 3.

Figure 9:
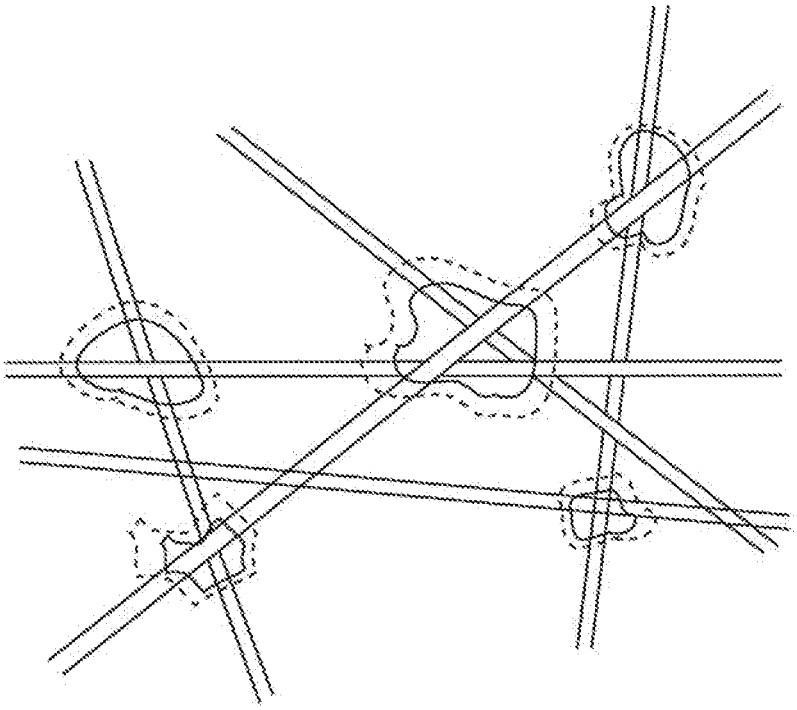
FIG. 9 is an enlarged conceptual diagram of a state after a water-soluble-polymer-partially-removing step in the present invention.

When a part of the water-soluble polymers is removed by heating treatment, the decomposition and denaturation of the water-soluble polymers are simultaneously caused in the partial removal step. Thus, in the provisionally-bonded paper after the partial removal step, water-soluble polymers that have not been removed and water-soluble polymers that have been denatured by heating treatment remain. FIG. 9 is a diagram illustrating a state of the polyimide fiber paper after the water-soluble-polymer-partially-removing step. A portion surrounded by a dotted line in the figure is a portion for step of the polyimide short fibers with the water-soluble polymers in the provisionally-bonded paper. Inside the portion surrounded by the dotted line, the portion indicated by the solid line refers to the water-soluble polymers and the heat-denatured products of the water-soluble polymers remaining in the polyimide fiber paper after completely removing the water-soluble polymers. As illustrated in the figure, even if a part of the water-soluble polymers are removed without imidization, the water-soluble polymers and the heat-denatured products of the water-soluble polymers fix the polyimide short fibers, and therefore the provisionally-bonded paper is not dispersed. In FIG. 9 that is a conceptual diagram illustrating a state after a water-soluble-polymer-partially-removing step, a portion representing the water-soluble polymers and the heat-denatured products of the water-soluble polymers indicated by the solid line is illustrated so as to be enlarged compared to the portion of the heat-denatured products of the water-soluble polymers indicated by the solid line in FIG. 7 that is a conceptual diagram illustrating the state after the water-soluble-polymer-completely-removing step. This is because the removal step is performed such that only a part of the water-soluble polymers is removed, and therefore an amount of the removed water-soluble polymers is smaller than that in the water-soluble-polymer-completely-removing step.

The polyimide short fibers after the water-soluble-polymer-partially-removing step can be heat-fused with other heat-fusible substances because the water-soluble polymers and the denatured water-soluble polymers have adhesiveness.

Embodiment 5. Effect of Invention

The polyimide fiber paper-manufacturing method of the present embodiment makes it possible to manufacture polyimide fiber paper having a uniform thickness, and a wide sheet-like polyimide fiber paper having a uniform thickness without using a special apparatus.

Embodiment 6

Embodiment 6. Summary

The invention in the present embodiment relates to a polyimide fiber paper-manufacturing method in which a polyimide precursor is dispersed not before but after the water-soluble-polymer-completely-removing step of the polyimide fiber paper-manufacturing method of Embodiment 4. Once the polyimide precursor is dispersed after the water-soluble-polymer-completely-removing step, the polyimide precursor forms a film (1002) including heat-denatured products of water-soluble polymers (1001) firmly bonding to the polyimide short fibers so as to wrap the polyimide short fibers so that the film wraps the polyimide short fibers, as illustrated in FIG. 10.

Embodiment 6. Configuration

Figure 11:
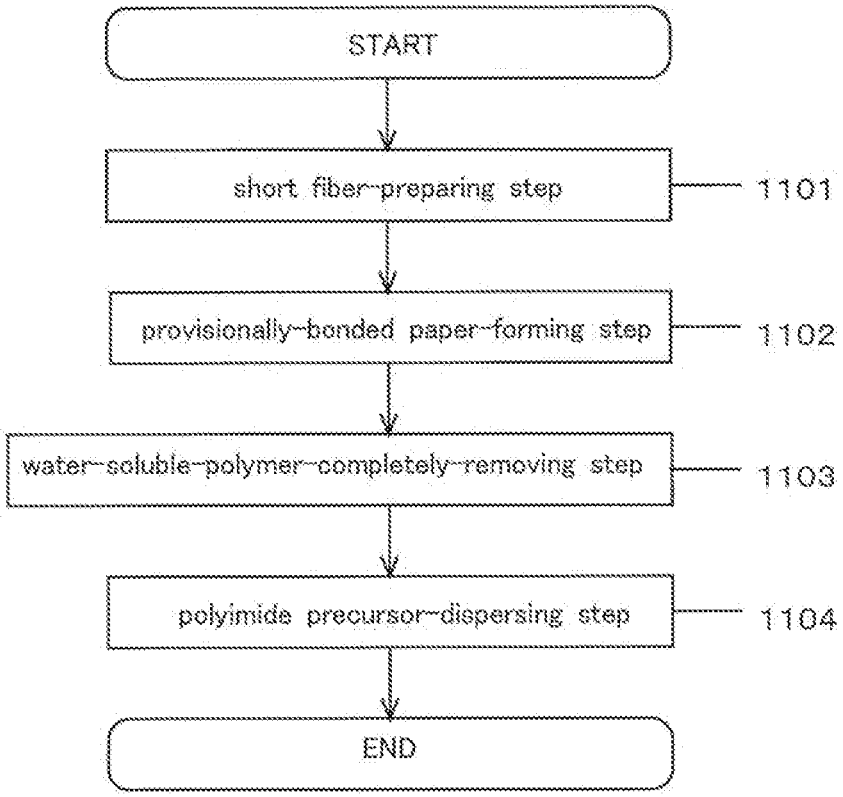
FIG. 11 is a flow chart illustrating an example of a polyimide fiber paper-manufacturing method in Embodiment 6.

FIG. 11 is a flow chart illustrating an example of the most basic polyimide fiber paper-manufacturing method of the present embodiment. As illustrated, the polyimide fiber paper-manufacturing method of the present embodiment includes a short fiber-preparing step (1101), a provisionally-bonded paper-forming step (1102), a water-soluble-polymer-completely-removing step (1103), and a polyimide precursor-dispersing step (1104). Explanation of the common configuration with any one of Embodiments 1 to 5 is omitted.

Figure 10:
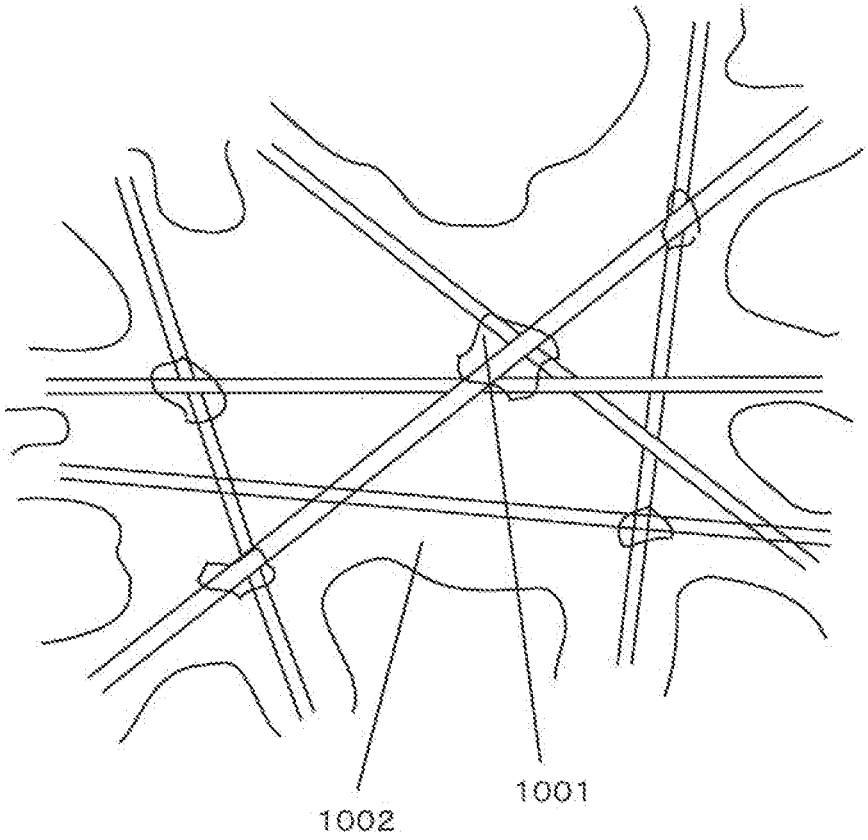
FIG. 10 is an enlarged conceptual diagram illustrating a state that the polyimide precursor solution or the polyimide solution is dispersed after the water-soluble-polymer-completely-removing step in the present invention.

As described above, once the polyimide precursor is dispersed after the water-soluble-polymer-completely-removing step, the polyimide precursor forms a film including heat-denatured products of water-soluble polymers firmly bonding to the polyimide short fibers so as to wrap the polyimide short fibers so that the film wraps the polyimide short fibers, as illustrated in FIG. 10. Through the water-soluble-polymer-completely-removing step, only the heat-denatured products of the water-soluble polymers fix the polyimide short fibers. Thus, a force for fixing the polyimide short fibers is weak. After the water-soluble-polymer-completely-removing step, if the tangled polyimide short fibers are unwound after the polyimide precursor-dispersing step and before the imidization of the polyimide precursor and the polyimide short fibers, the polyimide fiber paper cannot be manufactured. Thus, it is preferable that the polyimide short fibers shaved in Embodiment 6 are composed of fibers having a length and a width that facilitate entanglement of the fibers theirselves. The polyimide short fibers are easily tangled when the fiber length is relatively long and the fiber width is relatively small. For example, polyimide short fibers having a length of 5 mm or more and a width of 25 μm or less are suitable for manufacturing the polyimide fiber paper in Embodiment 6.

Embodiment 6. Effect of Invention

The polyimide fiber paper-manufacturing method of the present embodiment makes it possible to manufacture polyimide fiber paper having a uniform thickness, and wide sheet-like polyimide fiber paper having a uniform thickness without using a special apparatus.

Embodiment 7

Embodiment 7. Summary

The invention in the present embodiment relates to a polyimide fiber paper-manufacturing method in which a polyimide precursor is dispersed not before but after the water-soluble-polymer-partially-removing step of the polyimide fiber paper-manufacturing method of Embodiment 5. Once the polyimide is dispersed after the water-soluble-polymer-partially-removing step, the polyimide precursor forms a film (1202) including water-soluble polymers and heat-denatured products of the water-soluble polymers (1201) firmly bonding to the polyimide short fibers so as to wrap the polyimide short fibers so that the film wraps the polyimide short fibers, as illustrated in FIG. 12.

Embodiment 7. Configuration

Figure 13:
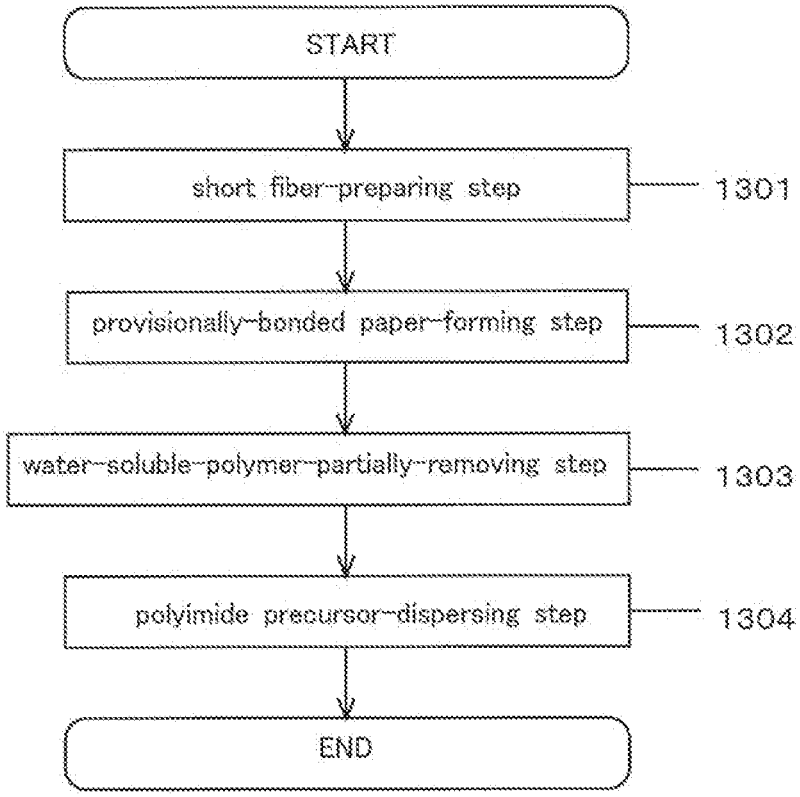
FIG. 13 is a flow chart illustrating an example of a polyimide fiber paper-manufacturing method in Embodiment 7.

FIG. 13 is a flow chart illustrating an example of the most basic polyimide fiber paper-manufacturing method of the present embodiment. As illustrated, the polyimide fiber paper-manufacturing method of the present embodiment includes a short fiber-preparing step (1301), a provisionally-bonded paper-forming step (1302), a water-soluble-polymer-partially-removing step (1303), and a polyimide precursor-dispersing step (1304). Explanation about the common configuration with any one of Embodiments 1 to 6 is omitted.

Figure 12:
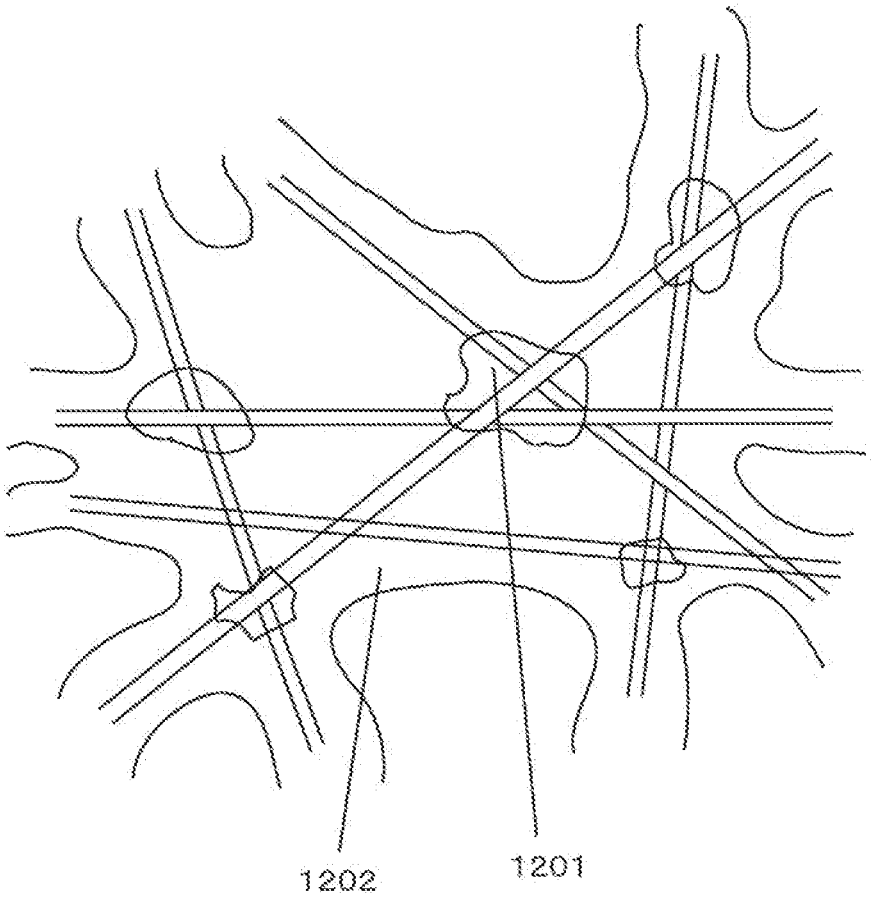
FIG. 12 is an enlarged conceptual diagram illustrating a state that the polyimide precursor solution or the polyimide solution is dispersed after the water-soluble-polymer-partially-removing step in the present invention.

As described above, once the polyimide precursor is dispersed after the water-soluble-polymer-partially-removing step, the polyimide precursor forms a film including water-soluble polymers and heat-denatured products of the water-soluble polymers firmly bonding to the polyimide short fibers so as to wrap the polyimide short fibers so that the film wraps the polyimide short fibers, as illustrated in FIG. 12. When the water-soluble polymers are partially removed, the polyimide short fibers are fixed not only by the heat-denatured products of the water-soluble polymers but also by the water-soluble polymers, unlike the case in Embodiment 6 in which the water-soluble polymers are completely removed. Thus, a mass of the water-soluble polymers and heat-denatured products of the water-soluble polymers fixing the polyimide short fibers is higher than that of the heat-denatured products of the water-soluble polymers alone. Furthermore, an area of the polyimide short fibers fixed by the water-soluble polymers and the heat-denatured products of the water-soluble polymers is larger than an area of the polyimide short fibers fixed by the heat-denatured products of the water-soluble polymers alone. For this reason, fixation of the polyimide short fibers after the water-soluble-polymer-partially-removing step is relatively strong. After the water-soluble-polymer-partially-removing step, a risk of unwinding entanglement of the polyimide short fibers after the polyimide precursor-dispersing step and before the imidization is relatively low, and even if the shaved polyimide short fibers are relatively short and relatively thick, the polyimide short fibers are not unwound. For example, polyimide short fibers having a length of 5 mm or less and a width of 25 μm or more are suitable for manufacturing the polyimide fiber paper in Embodiment 7.

Embodiment 7. Effect

The polyimide fiber paper-manufacturing method of the present embodiment makes it possible to manufacture polyimide fiber paper having a uniform thickness, and wide sheet-like polyimide fiber paper having a uniform thickness without using a special apparatus.

Embodiment 8

Embodiment 8. Summary

The invention in the present embodiment relates to a polyimide fiber paper-manufacturing method in which a polyimide solution is dispersed not before but after the water-soluble-polymer-completely-removing step of the polyimide fiber paper-manufacturing method of Embodiment 4. Similar to FIG. 10 illustrating a state that the polyimide precursor is dispersed after the water-soluble-polymer-completely-removing step, once the polyimide solution is dispersed after the water-soluble-polymer-completely-removing step, the polyimide solution forms a film including heat-denatured products of water-soluble polymers firmly bonding to the polyimide short fibers so as to wrap the polyimide short fibers so that the film wraps the polyimide short fibers.

Embodiment 8. Configuration

Figure 14:
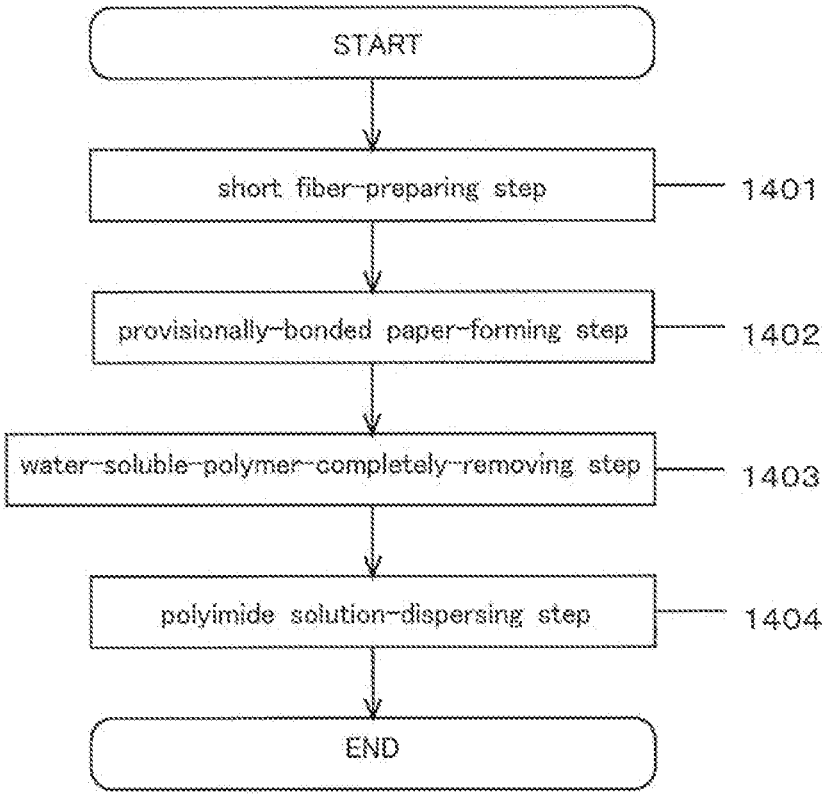
FIG. 14 is a flow chart illustrating an example of a polyimide fiber paper-manufacturing method in Embodiment 8.

FIG. 14 is a flow chart illustrating an example of the most basic polyimide fiber paper-manufacturing method of the present embodiment. As illustrated, the polyimide fiber paper-manufacturing method of the present embodiment includes a short fiber-preparing step (1401), a provisionally-bonded paper-forming step (1402), a water-soluble-polymer-completely-removing step (1403), and a polyimide solution-dispersing step (1404). Explanation about the common configuration with any one of Embodiments 1 to 7 is omitted.

As described above, once the polyimide solution is dispersed after the water-soluble-polymer-completely-removing step, the polyimide solution forms a film including heat-denatured products of water-soluble polymers firmly bonding to the polyimide short fibers so as to wrap the polyimide short fibers so that the film wraps the polyimide short fibers. Through the water-soluble-polymer-completely-removing step, only the heat-denatured products of the water-soluble polymers fix the polyimide short fibers. Thus, a force for fixing the polyimide short fibers is weak. After the water-soluble-polymer-completely-removing step, if the tangled polyimide short fibers are unwound after the polyimide-dispersing step and before the imidization of polyimide and the polyimide short fibers, the polyimide fiber paper cannot be manufactured.

Thus, it is preferable that the polyimide short fibers shaved in Embodiment 8 also have a length and a width that facilitate entanglement of the fibers theirselves, like Embodiment 6. The polyimide short fibers are easily tangled when the fiber length is relatively long and the fiber width is relatively small. For example, polyimide short fibers having a length of 5 mm or more and a width of 25 μm or less are also suitable for manufacturing the polyimide fiber paper in Embodiment 8.

Embodiment 8. Effect of Invention

The polyimide fiber paper-manufacturing method of the present embodiment makes it possible to manufacture polyimide fiber paper having a uniform thickness, and wide sheet-like polyimide fiber paper having a uniform thickness without using a special apparatus.

Embodiment 9

Embodiment 9. Summary

The invention in the present embodiment relates to a polyimide fiber paper-manufacturing method in which a polyimide solution is dispersed not before but after the water-soluble-polymer-partially-removing step of the polyimide fiber paper-manufacturing method of Embodiment 5. Similar to FIG. 12 illustrating a state that the polyimide precursor is dispersed after the water-soluble-polymer-partially-removing step, once the polyimide solution is dispersed after the water-soluble-polymer-partially-removing step, the polyimide solution forms a film including water-soluble polymers and heat-denatured products of the water-soluble polymers firmly bonding to the polyimide short fibers so as to wrap the polyimide short fibers so that the film wraps the polyimide short fibers.

Embodiment 9. Configuration

Figure 15:
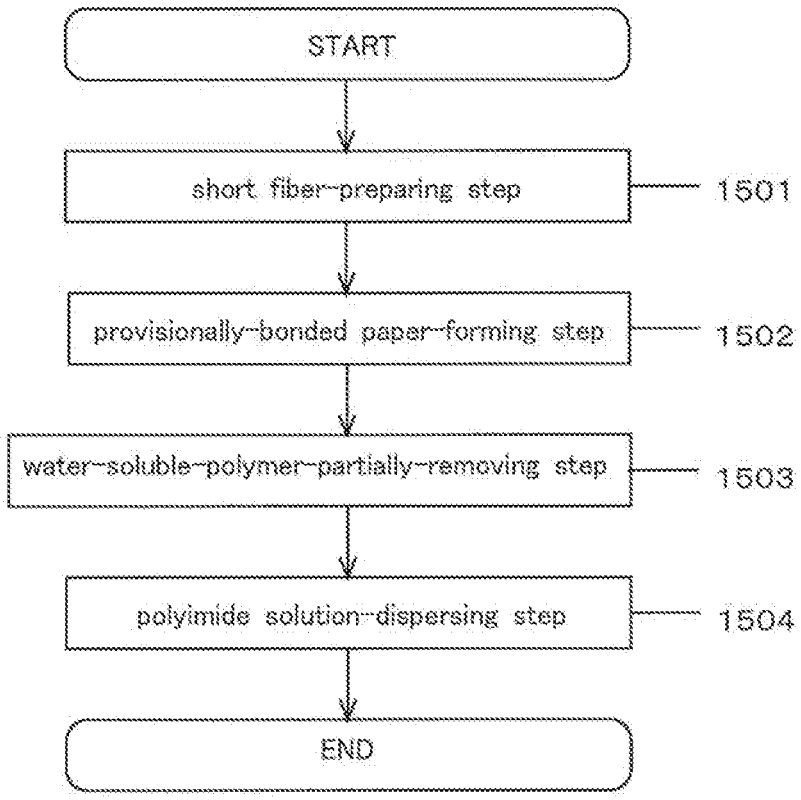
FIG. 15 is a flow chart illustrating an example of a polyimide fiber paper-manufacturing method in Embodiment 9.

FIG. 15 is a flow chart illustrating an example of the most basic polyimide fiber paper-manufacturing method of the present embodiment. As illustrated, the polyimide fiber paper-manufacturing method of the present embodiment includes a short fiber-preparing step (1501), a provisionally-bonded paper-forming step (1502), a water-soluble-polymer-partially-removing step (1503), and a polyimide solution-dispersing step (1504). Explanation of the common configuration with any one of Embodiments 1 to 8 is omitted.

As described above, similar to FIG. 12 illustrating a state that the polyimide precursor is dispersed after the water-soluble-polymer-partially-removing step, once the polyimide solution is dispersed after the water-soluble-polymer-partially-removing step, the polyimide solution forms a film including water-soluble polymers and heat-denatured products of the water-soluble polymers firmly bonding to the polyimide short fibers so as to wrap the polyimide short fibers so that the film wraps the polyimide short fibers. When the water-soluble polymers are partially removed, the polyimide short fibers are fixed not only by the heat-denatured products of the water-soluble polymers but also by the water-soluble polymers, like Embodiment 7. Thus, a mass of the fixed water-soluble polymers and heat-denatured products of the water-soluble polymers is higher than that of the heat-denatured products of the water-soluble polymers alone. Furthermore, an area of the polyimide short fibers fixed by the water-soluble polymers and heat-denatured products of the water-soluble polymers is larger than an area of the polyimide short fibers fixed by the heat-denatured products of the water-soluble polymers alone. For this reason, fixation of the polyimide short fibers after the water-soluble-polymer-partially-removing step is relatively strong. After the water-soluble-polymer-partially-removing step, a risk of unwinding entanglement of the polyimide short fibers after the polyimide-dispersing step and before the imidization is relatively low, and even if the shaved polyimide short fibers are relatively short and relatively thick, the polyimide short fibers are not unwound. For example, polyimide short fibers having a length of 5 mm or less and a width of 25 μm or more are also suitable for manufacturing the polyimide fiber paper in Embodiment 9.

Embodiment 9. Effect of Invention

The polyimide fiber paper-manufacturing method of the present embodiment makes it possible to manufacture polyimide fiber paper having a uniform thickness, and wide sheet-like polyimide fiber paper having a uniform thickness without using a special apparatus.

Embodiment 10

Embodiment 10. Summary

The invention in the present embodiment relates to a polyimide fiber paper-manufacturing method further including a step of performing heating treatment after the polyimide precursor-dispersing step of the polyimide fiber paper-manufacturing method according to Embodiment 6 or 7.

Embodiment 10. Configuration

Figure 16:
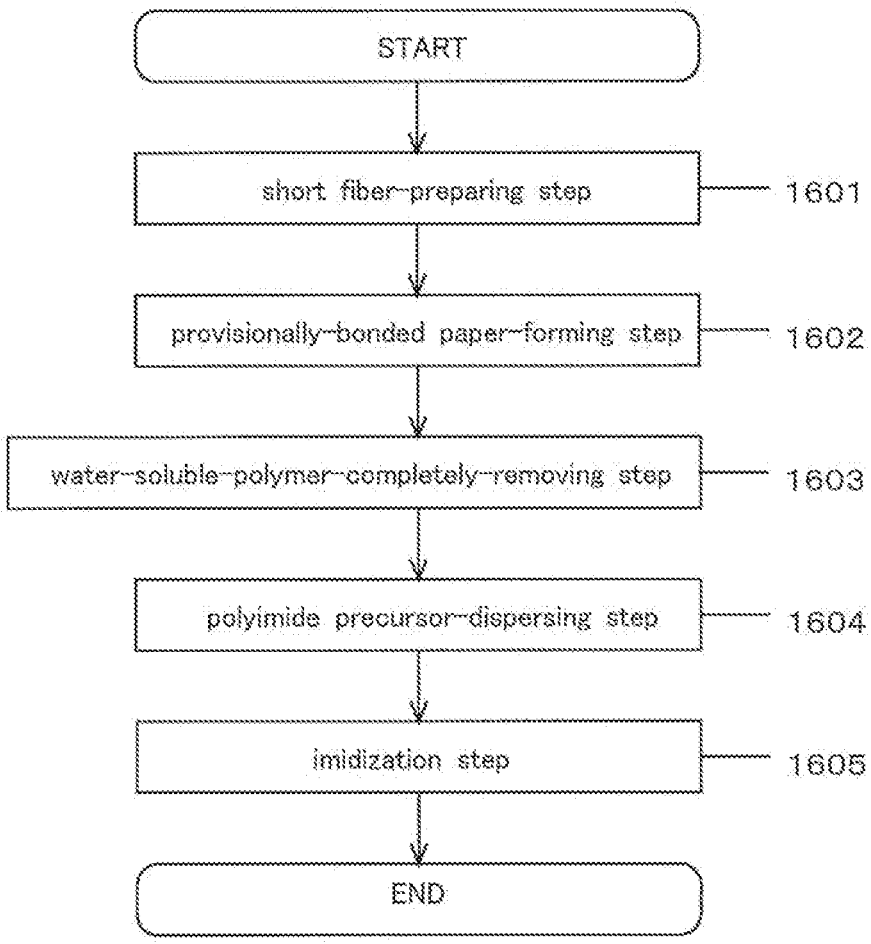
FIG. 16 is a flow chart illustrating an example of a polyimide fiber paper-manufacturing method in Embodiment 10.

FIG. 16 is a flow chart illustrating an example of the most basic polyimide fiber paper-manufacturing method of the present embodiment. As illustrated, the polyimide fiber paper-manufacturing method of the present embodiment includes a short fiber-preparing step (1601), a provisionally-bonded paper-forming step (1602), a water-soluble-polymer-completely-removing step (1603), a polyimide precursor-dispersing step (1604), and an imidization step (1605). In the following, explanation of the common configuration with any one of Embodiments 1 to 9 will be omitted, and the points characteristic of the present embodiment will be explained.

Embodiment 10. Explanation of Configuration

Embodiment 10. Imidization Step

In the "imidization step", the polyimide precursor is imidized by heating after the polyimide precursor-dispersing step. The polyimide fiber provisionally-bonded paper is rendered into a polyimide fiber paper in which the fibers are adhesively fixed by imidization. In the imidization step, as in the case of the water-soluble-polymer-completely-removing step, the provisionally-bonded paper is sandwiched between two heat rolls, and heated to imidize the polyimide precursor and to firmly bond the polyimide fibers using e.g. a machine generally called a calender processing machine.

Unlike the case of the water-soluble-polymer-completely-removing step, a temperature of the heat roll for imidization is set to 300° C. or higher. At this temperature, the polyimide precursor is imidized and firmly bonded to polyimide constituting the polyimide fiber paper.

Embodiment 10. Others

In the present embodiment, the provisionally-bonded paper is sandwiched between the heat rolls twice, i.e. during the step of completely or partially removing the water-soluble polymers and the imidization step. The provisionally-bonded paper is pressurized by being sandwiched between the heat rolls, and is thinned by the pressurization to have a thickness as of general paper. Note that a thickness and a surface shape of the paper can be changed depending on a degree of the pressurization and a shape of the heat rolls.

Furthermore, conversely the paper is expanded in a thickness direction by passing the paper through a heating furnace at 300° C. or higher under no pressure state without using the heat rolls, so that a void ratio per a unit thickness can be increased.

Embodiment 10. Effect of Invention

The polyimide fiber paper-manufacturing method of the present embodiment makes it possible to manufacture polyimide fiber paper having a uniform thickness, and wide sheet-like polyimide fiber paper having a uniform thickness without using a special apparatus.

Embodiment 11

<Embodiment 11. Summary

The invention in the present embodiment relates to a polyimide fiber paper-manufacturing method further including an imidization step after the polyimide solution-dispersing step of the polyimide fiber paper-manufacturing method according to Embodiment 8 or 9.

Embodiment 11. Configuration

Figure 17:
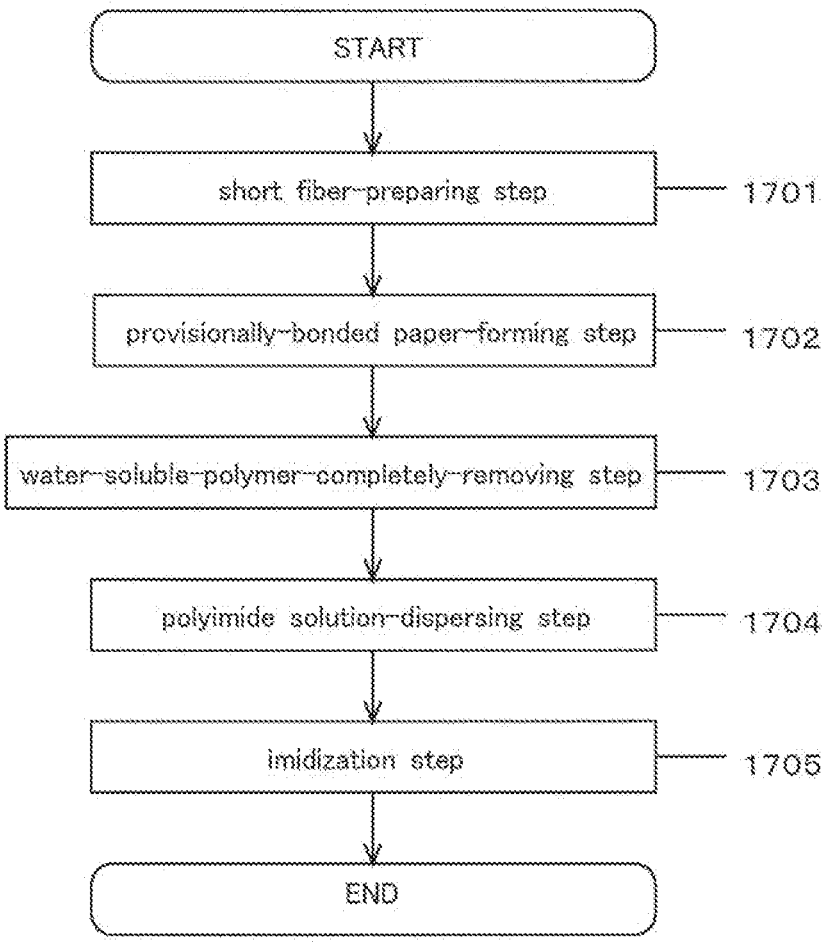
FIG. 17 is a flow chart illustrating an example of a polyimide fiber paper-manufacturing method in Embodiment 11.

FIG. 17 is a flow chart illustrating an example of the most basic polyimide fiber paper-manufacturing method of the present embodiment. As illustrated, the polyimide fiber paper-manufacturing method of the present embodiment includes a short fiber-preparing step (1701), a provisionally-bonded paper-forming step (1702), a water-soluble-polymer-completely-removing step (1703), a polyimide solution-dispersing step (1704), and an imidization step (1705). In the following, explanation of the common configuration with any one of Embodiments 1 to 10 will be omitted, and the point characteristic of the present embodiment will be explained.

Embodiment 11. Imidization Step

In the imidization step in the present embodiment, the polyimide precursor in the polyimide solution is subjected to an imidization reaction. As a result, the polyimide fibers in a provisionally-bonded state are adhesively fixed to each other so as to be a polyimide fiber paper. In the imidization step, as in the case of Embodiment 10 in which the polyimide precursor is used, the provisionally-bonded paper is sandwiched between two heat rolls, and heated at 300° C. or higher to imidize the polyimide precursor in the polyimide solution and to firmly bond the polyimide fiber papers using e.g. a machine generally called a calender processing machine.

Embodiment 11. Others

In the present embodiment, too, the provisionally-bonded paper is pressurized in the step of completely or partially removing the water-soluble polymers and the imidization step to have a thickness as of general paper as in Embodiment 10.

Note that a thickness and a surface shape of the paper can be changed depending on a degree of the pressurization and a shape of the heat rolls.

Furthermore, conversely the paper is expanded in a thickness direction by passing the paper through a heating furnace at 300° C. or higher under no pressure state without using the heat rolls, so that a void ratio per a unit thickness can be increased.

Embodiment 11. Effect of Invention

The polyimide fiber paper-manufacturing method of the present embodiment makes it possible to manufacture polyimide fiber paper having a uniform thickness, and wide sheet-like polyimide fiber paper having a uniform thickness without using a special apparatus.

Embodiment 12

Embodiment 12. Summary

The invention of the present embodiment is produced in an intermediate stage for manufacturing the polyimide fiber paper.

Embodiment 12. Configuration

The invention of Embodiment 12 is a polyimide fiber paper intermediate structure A, which is a nonwoven fabric made of the shaved short fibers of the non-thermoplastic polyimide. In the polyimide fiber paper intermediate structure A, water-soluble polymers having a decomposition temperature lower than a glass transition point of polyimide are dispersed in the nonwoven fabric. The water-soluble polymers have a heat fusibility different from the characteristic of the non-thermoplastic polyimide, and the water-soluble polymers in the polyimide fiber paper intermediate structure A can be fused with another heat-fusible substance by heat fusion. Thus, the polyimide fiber paper intermediate structure A has adhesiveness.

Embodiment 12. Effect of Invention

The invention in the present embodiment can provide a paper-like material in which a polyimide is a main constituent component, but meanwhile a polyimide having a viscosity allowing fusion with another substance and unacquirable only by the non-thermoplastic polyimide is also a main constituent component.

Embodiment 13

Embodiment 13. Summary

The invention of the present embodiment is produced in an intermediate stage for manufacturing the polyimide fiber paper.

Embodiment 13. Configuration

The invention in the present embodiment is a polyimide fiber paper intermediate structure B, which is a nonwoven fabric made of the shaved short fibers of the thermoplastic polyimide. In the polyimide fiber paper intermediate structure B, heat-denatured products of water-soluble polymers having a decomposition temperature lower than a glass transition point of polyimide are dispersed in the nonwoven fabric. Once the water-soluble polymers are heated, two reactions, decomposition and denaturation are caused, decomposed water-soluble polymers are removed from the nonwoven fabric, and heat-denatured products of the water-soluble polymers remain in the nonwoven fabric. The heat-denatured products of the water-soluble polymers have heat fusibility like the water-soluble polymers before heat denaturation. Thus, once the heat-denatured products of the water-soluble polymers are heated, it exhibits viscosity and can be fused with another substance. Consequently, the polyimide fiber paper intermediate structure B has fusibility.

Embodiment 13. Effect of Invention

The invention in the present embodiment makes it possible to provide polyimide fiber paper having a uniform thickness and a viscosity allowing fusion with another substance, as well as wide sheet-like polyimide fiber paper having a uniform thickness and a viscosity allowing fusion with another substance without using a special apparatus.

Embodiment 14

Embodiment 14. Summary

The invention of the present embodiment is produced in an intermediate stage for manufacturing the polyimide fiber paper.

Embodiment 14. Configuration

The invention in the present embodiment is a polyimide fiber paper intermediate structure C, which is a nonwoven fabric made of the shaved short fibers of the non-thermoplastic polyimide. The polyimide fiber paper intermediate structure C is obtained by dispersing heat-denatured products of water-soluble polymers having a decomposition temperature lower than a glass transition point of polyimide in the nonwoven fabric, and further subjecting the nonwoven fabric to impregnation with the polyimide precursor and/or the polyimide solution and drying. The heat-denatured products of the water-soluble polymers can be heat-fused, and this property is not lost even when the nonwoven fabric is impregnated with the polyimide precursor and/or the polyimide solution. Consequently, the polyimide fiber paper intermediate structure C has adhesiveness, and can be heat-fused with another adhesive substance by heating.

Embodiment 14. Effect of Invention

The invention in the present embodiment makes it possible to provide polyimide fiber paper having a uniform thickness and a viscosity allowing fusion with another substance, as well as wide sheet-like polyimide fiber paper having a uniform thickness and a viscosity allowing fusion with another substance without using a special apparatus.

Embodiment 15

The invention in the present embodiment shows the optimum range of a weight of the water-soluble polymers in the polyimide fiber paper-manufacturing method according to any one of Embodiments 1 to 11. The optimum range of the weight of the water-soluble polymers is greater than or equal to 1 wt % and less than or equal to 50 wt % with respect to polyimide. If the amount of the water-soluble polymers is too large, a portion having contained the water-soluble polymers becomes too hollow when the water-soluble polymers are removed, and a strength and an effect as the polyimide fiber paper becomes insufficient. On the other hand, if the amount of the water-soluble polymers is too small, a force for provisionally fixing polyimide is too weak due to fusion of the water-soluble polymers, and the provisional bonding becomes impossible. Consequently, there is the optimum range for the weight of the water-soluble polymers.

Embodiment 16

The invention in the present embodiment shows the optimum type for the water-soluble polymers in the polyimide fiber paper-manufacturing method according to any one of Embodiments 1 to 11 and 15. The optimum water-soluble polymer for producing the polyimide fiber paper is any one or more of starch, alginic acid, carboxymethylcellulose, casein, vinylon, polyvinyl alcohol, vinyl acetate, polyvinyl acetate and/or derivatives thereof. Although there are many types of water-soluble polymers, strength of the heat fusion, the degree of the heat denaturation due to the removal step, and the like are different depending on types of the polymers. When any one or more of polymers listed above are used, the optimum water-soluble polymers for manufacturing the polyimide fiber paper can be prepared.

Embodiment 17

The invention in the present embodiment shows the optimum types for the polyimide precursor and the polyimide solution in the polyimide fiber paper-manufacturing method according to any one of Embodiments 1 to 11 and 16.

The polyimide precursor is a non-thermoplastic polyimide precursor obtained by polymerizing an aromatic diamine component and an aromatic acid anhydride component in an organic solvent, or a non-thermoplastic polyimide precursor transferred into a solvent different from the solvent used for polymerization after condensation polymerization.

The aromatic diamine component contained in the polyimide precursor is any one or more selected from a group consisting of paraphenylenediamine, 1,3-bis(4-aminophenoxy)benzene, 4,4'-diaminodiphenyl ether, and 3,4'-diaminodiphenyl ether, but may additionally contain an aromatic diamine component other than these components.

The aromatic acid anhydride component contained in the polyimide precursor is any one or more selected from a group consisting of 4,4'-oxydiphthalic anhydride, pyromellitic dianhydride, and 3,3',4,4'-biphenyltetracarboxylic dianhydride, but may additionally contain an aromatic acid anhydride component other than these components.

Examples of the organic solvent used for forming the polyamic acid solution contained in the polyimide precursor include: a sulfoxide-based solvent such as dimethylsulfoxide and diethylsulfoxide; a formamide-based solvent such as N,N-dimethylformamide and N,N-diethylformamide; an acetamide-based solvent such as N,N-dimethylacetamide and N,N-diethylacetamide; a pyrrolidone-based solvent such as N-methyl-2-pyrrolidone and N-vinyl-2-pyrrolidone; a phenol-based solvent such as phenol, o-, m- or p-cresol, xylenol, halogenated phenol, and catechol; or an aprotic polar solvent such as hexamethylphosphoramide and γ-butyrolactone; and the like. Furthermore, xylene, toluene, acetone, water and the like can also be used.

The polyimide solution contains at least a precursor component supposed to become a non-thermoplastic polyimide by imidization reaction, and a non-thermoplastic polyimide component.

The non-thermoplastic polyimide contained in the polyimide solution is not specified, but is preferably obtained from a polyimide precursor composed of an aromatic diamine and an aromatic acid anhydride.

The precursor component contained in the polyimide solution and supposed to become a non-thermoplastic polyimide by imidization reaction is not specified, but can be exemplified by a polyimide precursor as obtained in the above paragraphs regarding Embodiment 17, and the like.

Examples of the solvent used for the polyimide solution are not particularly specified, but include: a sulfoxide-based solvent such as dimethylsulfoxide and diethylsulfoxide; a formamide-based solvent such as N,N-dimethylformamide and N,N-diethylformamide; an acetamide-based solvent such as N,N-dimethylacetamide and N,N-diethylacetamide; a pyrrolidone-based solvent such as N-methyl-2-pyrrolidone and N-vinyl-2-pyrrolidone; a phenol-based solvent such as phenol, o-, m- or p-cresol, xylenol, halogenated phenol, and catechol; or an aprotic polar solvent such as hexamethylphosphoramide and γ-butyrolactone; and the like. Furthermore, xylene, toluene, acetone, water and the like can also be used.

Embodiment 18

The invention in the present embodiment shows an appropriate length of the polyimide short fibers in the polyimide fiber paper-manufacturing method described in any one of Embodiments 1 to 11 and 15 to 17. The appropriate length of the polyimide short fibers is greater than or equal to 1.0 mm and less than or equal to 10.0 mm. If the polyimide short fibers are too short, the polyimide fibers are not sufficiently tangled in a slurry, and even if the polyimide fibers are screened, sufficient entanglement as a nonwoven fabric cannot be obtained. Thus, it is difficult to provisionally bond the fibers even using the water-soluble polymers. On the other hand, if the polyimide short fibers are too long, entanglement will be complicatedly overlapped, the smooth surface cannot be obtained even by heating and pressurization, and sufficient finishing quality as paper cannot be obtained. Consequently, there is an appropriate length for the polyimide short fibers.

As long as the length is within a range of appropriate lengths, finishing quality as paper is sufficient, but a polyimide density per a unit area fluctuates depending on the fiber length. Thus, there may be slight differences in expressivities of characteristics such as heat resistance and mechanical strength of polyimide. Consequently, it is preferable to configure the polyimide short fibers by selecting one or more lengths from the appropriate length range according to the intended purpose.

Embodiment 19

The invention in the present embodiment shows an optimal length of the polyimide short fibers in the polyimide fiber paper-manufacturing method according to Embodiments 18. The optimal length of the polyimide short fibers is greater than or equal to 2.0 mm and less than or equal to 6.0 mm. It has already been explained that the manufacturing process and finishing quality fluctuate depending on the lengths of the polyimide short fibers. From these manufacturing process and finishing quality, presence of the appropriate length was pointed out in Embodiment 18, but furthermore the optimum length is a length of a polyimide short fiber meeting conditions that optimally satisfy all of the stability of the manufacturing process, the finishing quality of the paper, and the effects of the finished polyimide fiber paper and the intermediate structure thereof.

Embodiment 20

Figure 18:
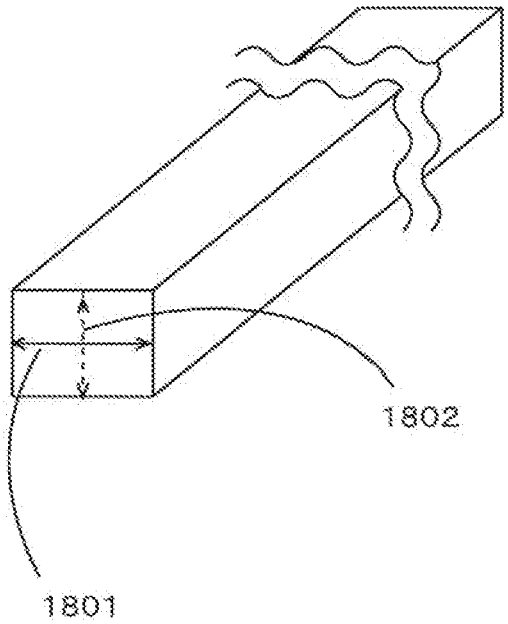
FIG. 18 is an enlarged conceptual diagram of a polyimide short fiber in the present invention.

The invention in the present embodiment shows an appropriate range of width values of the polyimide short fibers in the polyimide fiber paper-manufacturing method according to any one of Embodiments 1 to 11 and 15 to 19. FIG. 18 is a conceptual diagram of the polyimide short fiber. The length indicated by the solid line in the figure is a width (1801) of the polyimide short fiber, and the length indicated by the dotted line in the figure is a height (1802) of the polyimide short fiber. In association with the relationship between the widths of the polyimide short fiber and the height of the polyimide short fiber, one of them may be longer than the other one, or the two may be equal.

The appropriate width of the polyimide short fibers is greater than or equal to 1 μm and less than or equal to 50 μm. Flexibility of the polyimide short fiber varies depending on the width of the polyimide short fiber. A thick polyimide short fiber is hard to bend, and a thin polyimide short fiber is flexible and easy to bend. Thus, complexity of the polyimide short fibers tangled with the polyimide short fibers and the water-soluble polymers varies depending on the width of the polyimide short fibers. In the case of simple entanglement, entanglement of the polyimide short fibers may be unwound by a slight impact, resulting in weak strength of finished paper. On the other hand, in the case of excessively complicated entanglement, the tangled portions overlap and become thicker, so that the finished paper is not smooth, resulting in insufficient perfection as paper. Consequently, there is an appropriate width described above for the width of the polyimide short fibers.

As described above, the polyimide short fibers are shaved by applying a blade to a side face of a roll of the polyimide film. The height of the polyimide short fibers depends on the thickness of the polyimide film, and the width of the polyimide short fibers is adjusted by the blade for shaving the fibers from the side face. For the thickness of the polyimide film, a polyimide film having a thickness of greater than or equal to 1 μm and less than or equal to 50 μm is suitable as a polyimide film roll from which the polyimide short fibers are cut in manufacturing the polyimide fiber paper. Furthermore, a polyimide film having a thickness of greater than or equal to 3 μm and less than or equal to 25 μm is optimum as a polyimide film roll from which the polyimide short fibers are cut in manufacturing the polyimide fiber paper.

Embodiment 21

In the invention in the present embodiment, an optimal width of the polyimide short fibers in the polyimide fiber paper-manufacturing method according to Embodiments 20 is disclosed. The optimal width of the polyimide short fibers is greater than or equal to 3 μm and less than or equal to 25 μm. It has already been explained that the manufacturing process and finishing quality fluctuate depending on the widths of the polyimide short fibers. From these manufacturing process and finishing quality, presence of the appropriate width was pointed out in Embodiment 19, but furthermore the optimum width is a width of a polyimide short fiber meeting conditions that optimally satisfy all of the stability of the manufacturing process, the finishing quality of the paper, and the effects of the finished polyimide fiber paper and the intermediate structure thereof Others Embodiments 15 to 21 show appropriate conditions or optimum conditions for manufacturing the polyimide fiber paper according to the present polyimide fiber paper-manufacturing method. Since the weight of the water-soluble polymers, the type of the water-soluble polymers, the length of the polyimide short fibers, and the width of the polyimide short fibers influence each other, the finishing quality and the properties of the finished paper are determined by the aforementioned complexly correlating elements. Thus, it is necessary to make consideration for an optimum combination of the elements in accordance with an intended use of the manufactured paper, and conditions of the heating treatment required for the manufacturing process.

INDUSTRIAL APPLICABILITY

The polyimide fiber paper according to the present invention can be used as a circuit board material, a heat-resistant heat-insulating material, a sound absorbing material, an insulating material for a motor or a power generator, or a heat-resistant filter.

The invention claimed is:

1. A polyimide fiber paper-manufacturing method, comprising:

a short fiber-preparing step in which shaved short fibers of a non-thermoplastic polyimide are prepared; and a provisionally-bonded paper-forming step in which the shaved short fibers are mixed into a solution of water-soluble polymers which are a material having a decomposition temperature lower than a glass transition point of the polyimide, and subjected to wet-papermaking to form provisionally-bonded paper to which the shaved short fibers are provisionally bonded, wherein the shaved short fibers are mutually bonded due to imidization of a polyimide precursor, and the water-soluble polymers are removed by heat-treating after the provisionally-bonded paper-forming step.

2. The polyimide fiber paper-manufacturing method according to claim 1, wherein the water-soluble polymers are completely removed by the heat-treating after the provisionally-bonded paper-forming step, the polyimide precursor is dispersed in the provisionally-bonded paper after the water-soluble polymers are completely removed, and the polyimide precursor is imidized by heating after the polyimide precursor is dispersed in the provisionally-bonded paper.

3. The polyimide fiber paper-manufacturing method according to claim 1, wherein the water-soluble polymers are partially removed by the heat-treating after the provisionally-bonded paper-forming step, the polyimide precursor is dispersed in the provisionally-bonded paper after the water-soluble polymers are partially removed, and the polyimide precursor is imidized by heating after the polyimide precursor is dispersed in the provisionally-bonded paper.

4. The polyimide fiber paper-manufacturing method according to claim 1, wherein the water-soluble polymers are completely removed by the heat-treating after the provisionally-bonded paper-forming step, a polyimide solution, in which the polyimide precursor is contained, is dispersed in the provisionally-bonded paper after the water-soluble polymers are completely removed, and the polyimide precursor contained in the polyimide solution is imidized by heating after the polyimide solution is dispersed in the provisionally-bonded paper.

5. The polyimide fiber paper-manufacturing method according to claim 1, wherein the water-soluble polymers are partially removed by the heat-treating after the provisionally-bonded paper-forming step, a polyimide solution, in which the polyimide precursor is contained, is dispersed in the provisionally-bonded paper after the water-soluble polymers are partially removed, and the polyimide precursor contained in the polyimide solution is imidized by heating after the polyimide solution is dispersed in the provisionally-bonded paper.

6. A polyimide fiber paper-manufacturing method, comprising:

a short fiber-preparing step in which shaved short fibers of a non-thermoplastic polyimide are prepared;

a provisionally-bonded paper-forming step in which the shaved short fibers are mixed into a solution of water-soluble polymers which are a material having a decomposition temperature lower than a glass transition point of the polyimide, and subjected to wet-papermaking to form provisionally-bonded paper to which the shaved short fibers are provisionally bonded; and a polyimide precursor-dispersing step in which a polyimide precursor is dispersed in the provisionally-bonded paper after the provisionally-bonded paper-forming step, wherein, when the polyimide precursor is dispersed in the provisionally-bonded paper, the shaved short fibers are mutually bonded due to imidization of the polyimide precursor, and the water-soluble polymers are removed by heat-treating after the provisionally-bonded paper-forming step.

7. The polyimide fiber paper-manufacturing method according to claim 6, wherein the water-soluble polymers are completely removed by the heat-treating after the provisionally-bonded paper-forming step, the polyimide precursor is dispersed in the provisionally-bonded paper after the water-soluble polymers are completely removed, and the polyimide precursor is imidized by heating.

8. The polyimide fiber paper-manufacturing method according to claim 6, wherein the water-soluble polymers are partially removed by the heat-treating after the provisionally-bonded paper-forming step, the polyimide precursor is dispersed in the provisionally-bonded paper after the water-soluble polymers are partially removed, and the polyimide precursor is imidized by heating.

9. The polyimide fiber paper-manufacturing method according to claim 6, wherein the water-soluble polymers are completely removed by the heat-treating after the provisionally-bonded paper-forming step, a polyimide solution, in which the polyimide precursor is contained, is dispersed in the provisionally-bonded paper after the water-soluble polymers are completely removed, and the polyimide precursor contained in the polyimide solution is imidized by heating.

10. The polyimide fiber paper-manufacturing method according to claim 6, wherein the water-soluble polymers are partially removed by the heat-treating after the provisionally-bonded paper-forming step, a polyimide solution, in which the polyimide precursor is contained, is dispersed in the provisionally-bonded paper after the water-soluble polymers are partially removed, and the polyimide precursor contained in the polyamide solution is imidized by heating.

11. A polyimide fiber paper-manufacturing method, comprising:

a short fiber-preparing step in which shaved short fibers of a non-thermoplastic polyimide are prepared;

a provisionally-bonded paper-forming step in which the shaved short fibers are mixed into a solution of water-soluble polymers which are a material having a decomposition temperature lower than a glass transition point of the polyimide, and subjected to wet-papermaking to form provisionally-bonded paper to which the shaved short fibers are provisionally bonded; and a polyimide solution-dispersing step in which a polyimide solution, in which a polyimide precursor is contained, is dispersed in the provisionally-bonded paper after the provisionally-bonded paper-forming step, wherein, when the polyimide precursor is dispersed in the provisionally-bonded paper, the shaved short fibers are mutually bonded due to imidization of the polyimide precursor, and the water-soluble polymers are removed by heat-treating after the provisionally-bonded paper-forming step.

12. The polyimide fiber paper-manufacturing method according to claim 11, wherein the water-soluble polymers are completely removed by the heat-treating after the provisionally-bonded paper-forming step, the polyimide precursor is dispersed in the provisionally-bonded paper after the water-soluble polymers are completely removed, and the polyimide precursor is imidized by heating.

13. The polyimide fiber paper-manufacturing method according to claim 11, wherein the water-soluble polymers are partially removed by the heat-treating after the provisionally-bonded paper-forming step, the polyimide precursor is dispersed in the provisionally-bonded paper after the water-soluble polymers are partially removed, and the polyimide precursor is imidized by heating.

14. The polyimide fiber paper-manufacturing method according to claim 11, wherein the water-soluble polymers are completely removed by the heat-treating after the provisionally-bonded paper-forming step, the polyimide solution, in which the polyimide precursor is contained, is dispersed in the provisionally-bonded paper after the water-soluble polymers are completely removed, and the polyimide precursor contained in the polyamide solution is imidized by heating.

15. The polyimide fiber paper-manufacturing method according to claim 11, wherein the water-soluble polymers are partially removed by the heat-treating after the provisionally-bonded paper-forming step, the polyimide solution, in which the polyimide precursor is contained, is dispersed in the provisionally-bonded paper after the water-soluble polymers are partially removed, and the polyimide precursor contained in the polyamide solution is imidized by heating.

* * * * *